US006253594B1

(12) United States Patent
Stallings

(10) Patent No.: US 6,253,594 B1
(45) Date of Patent: Jul. 3, 2001

(54) METHOD OF PRODUCING A STAMPED ITEM

(75) Inventor: Hulon D. Stallings, Grosse Isle, MI (US)

(73) Assignee: Trans-Matic Manufacturing Company, Holland, MI (US)

( * ) Notice: Subject to any disclaimer, the term of this patent is extended or adjusted under 35 U.S.C. 154(b) by 0 days.

(21) Appl. No.: 09/549,690

(22) Filed: Apr. 14, 2000

(51) Int. Cl.[7] ..... B21D 28/28; B21D 28/32
(52) U.S. Cl. ..... 72/335; 72/333; 72/348
(58) Field of Search ..... 72/335, 336, 337, 72/327, 329, 348, 333

(56) References Cited

U.S. PATENT DOCUMENTS 1,040,567 * 10/1912 Newell ..... 72/348
1,712,076 * 5/1929 Hughes ..... 29/898.67
2,086,488 * 7/1937 Batie ..... 72/348
4,291,567 * 9/1981 Murayama ..... 72/335
5,761,949 * 6/1998 Dalessandro ..... 72/348

* cited by examiner

*Primary Examiner*—Daniel C. Crane
(74) *Attorney, Agent, or Firm*—Warner Norcross & Judd LLP

(57) ABSTRACT

A method of forming a hollow, bullet-shaped article having a strap extending across the normally closed end. The method includes the steps of drawing a metal blank into a cylindrical cup, piercing the bottom of the cup in at least two locations to form a strap, and reducing the diameter of the cup while leaving the length of the strap substantially unchanged so that the strap arcs away from the cup.

14 Claims, 5 Drawing Sheets

METHOD OF PRODUCING A STAMPED ITEM

BACKGROUND OF THE INVENTION

The present invention relates to the stamping of metal products, and more particularly to deep-drawn stamping.

There is a demand for metallic items or parts that are bullet-shaped and hollow, and that include one or more holes in the normally closed end. For example, one such item is a spark plug ground shield 10 (FIGS. 31–32) incorporated into a spark plug 20 (FIG. 3). The ground shield is essentially bullet-shaped and hollow, having a cylindrical side wall 12 and a strap 14. The strap is integral with the side wall and extends diametrically across the normally closed end of the ground shield 10.

Typically, the ground shield 10 is fabricated by, first, stamping a metal blank into a bullet shape and, second, machining the closed end to create the strap 14 arcing away from the remainder of the piece. This process is undesirably labor-intensive and therefore expensive and prone to quality and consistency issues.

While at first blush, the ground shield 10 appears to be capable of manufacture using deep-drawn stamping exclusively (i.e. no machining), such manufacture is not possible. Specifically if the strap 14 were formed by piercing the piece, the strap could not thereafter be pulled away from, or arced away from, the remainder of the piece because insufficient metal is left in the strap to withstand such forces.

SUMMARY OF THE INVENTION

The aforementioned problems are overcome in the present invention wherein an elongated, hollow piece having one or more straps over the normally closed end is produced solely using deep-drawn stamping. The process includes the steps of drawing a metal blank into a cup, piercing the bottom of the cup to create a strap in place of the bottom, and reducing the width of the cup without reducing the length of the strap so that the strap arcs away from the remainder of the piece. In the preferred embodiment, the initial forming step is a series of draws and/or redraws to create the cup. And, after the bottom is pierced, the item is reduced in width through a series of push reductions.

Each of the deep-drawn steps is individually known to those skilled in the deep-drawn stamping art. However, the process of the present invention is novel sequence of the steps, enabling the deep-drawn manufacture of a wide variety of parts nor previously possible.

The present invention eliminates the need to machine the pieces following stamping. Consequently, the pieces are produced with less labor and therefore are less expensive. Further, the quality and consistency of pieces is improved.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
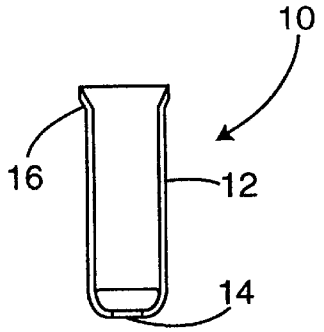
FIG. 1 is a sectional view of a spark plug ground shield manufactured in accordance with the process of the present invention.
Figure 2:
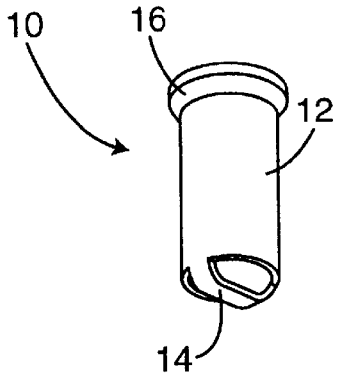
FIG. 2 is a perspective view of the ground shield.

A spark plug ground shield fabricated in accordance with the process of the present invention is illustrated in FIGS. 1 and 2 and generally designated 10. The ground shield 10 is an elongated, hollow, bullet-shaped object. The shield 10 includes a cylindrical side wall 12 of uniform diameter throughout its height and a strap 14 extending diametrically across one end of the side wall 12. The upper or open end 16 of the side wall 12 is flared outwardly. The strap 14 arcs away from the side wall 12.

Figure 3:
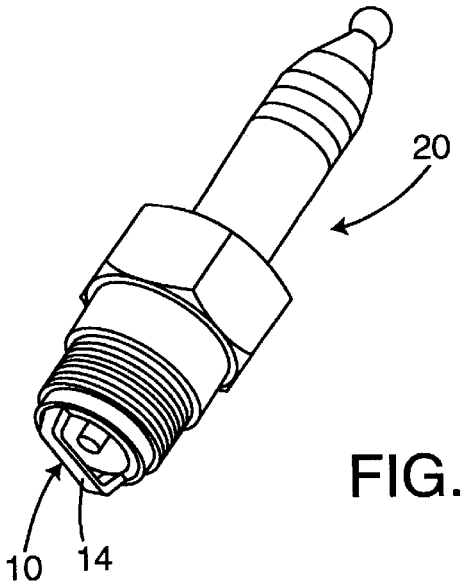
FIG. 3 is a perspective view of a spark plug incorporating the ground shield.

As illustrated in FIG. 3, the ground shield 10 is ultimately incorporated into a spark plug 20. The construction of the spark plug 20 is generally well known to those having ordinary skill in the spark plug art and therefore will not be described in this specification.

The ground shield 10 of the present invention is fabricated using only deep-drawn stamping techniques. FIGS. 4–32 show the configuration of the shield 10 (and several alternative embodiments) at each stage of the stamping process. The implementation of the dies and fixtures to implement each stage are known to those skilled in the deep-drawn stamping art and therefore are not illustrated or described.

Figure 4:
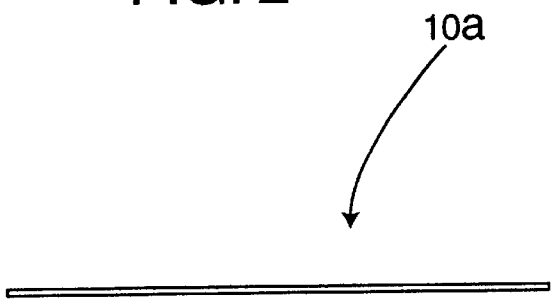
FIGS. 4–15 are sectional views (even-numbered Figs.) and perspective views (odd-numbered Figs.) of the piece at various stages of the manufacturing process through piercing.
Figure 5:
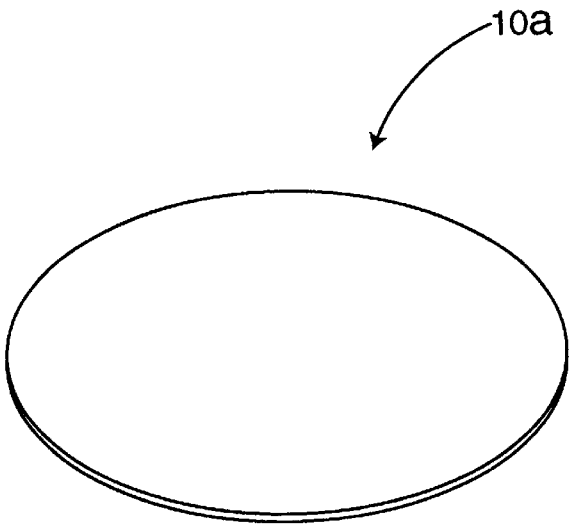

The first step in forming the shield 10 is a blanking step to create a circular planar disk 10*a* of material (FIGS. 4–5). The material is a non-resiliently deformable material such as 0.042 Inconel 600. Other materials now or later known to be suitable for stamping may be substituted. For the disclosed spark plug ground shield, the material should also be electrically conductive. However, the invention has applications well beyond the spark plug environment, and electrical conductivity may or may not be desirable in any particular application.

Figure 6:
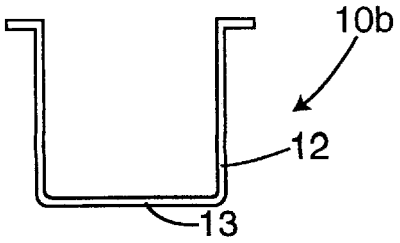
Figure 7:
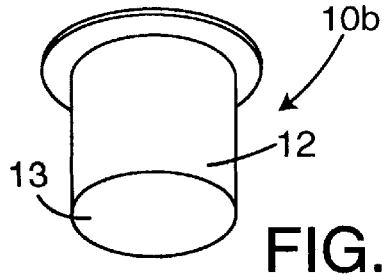

The second step is to draw the blank 10*a* into a cup 10*b* (FIGS. 6–7). This step initially forms a side wall 12 and a solid bottom 13. A top or shoulder 15 extends radially outwardly from the open end of the cup 10*b*.

Figure 8:
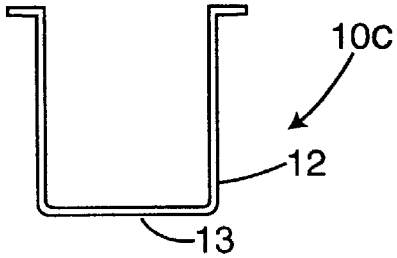
Figure 9:
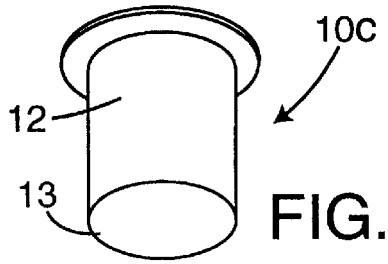

The third step is to redraw the cup 10*b* into a deeper cup 10*c* (FIGS. 8–9). The side wall 12 of the cup 10*c* is longer or higher than in 10*b*, and the bottom 13 of the cup 10*c* is narrower than the bottom in 10*b*.

Figure 10:
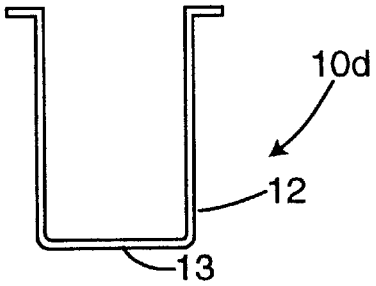
Figure 11:
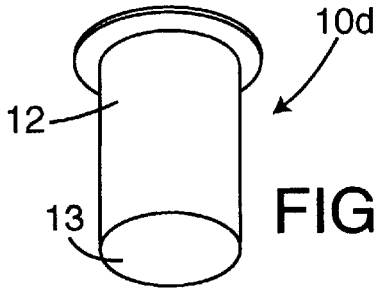

The fourth step is another redraw to produce the intermediate form 10*d* (FIGS. 10–11). Again, the side wall 12 has become higher; and the bottom 13 has become narrower.

Figure 12:
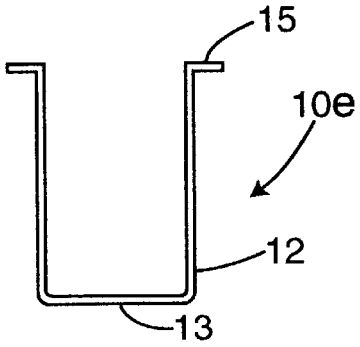
Figure 13:
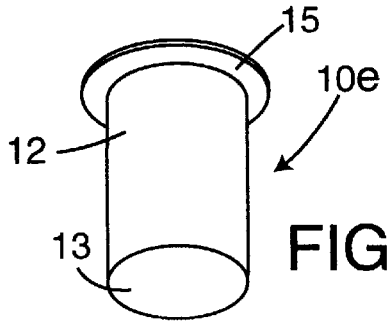

The fifth step is a re-strike to produce the intermediate form 10*e* (FIGS. 12–13). The re-strike flattens both the bottom 13 and the top 15 to assist in meeting dimensional tolerances.

Figure 14:
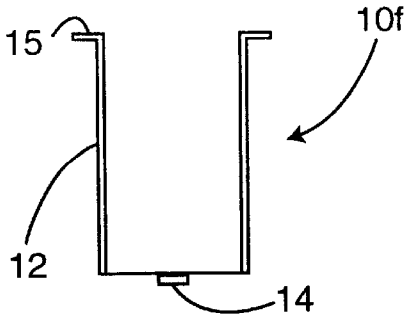
Figure 15:
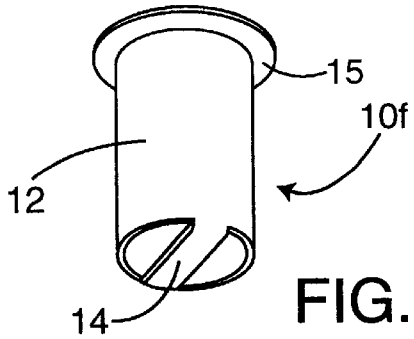

In the sixth step, the bottom is pierced to form the strap 14 on the intermediate form 10*f* (FIGS. 14–15). "Piercing" is a term of art in the deep-drawn stamping field that refers to the removal of material. Piercing should therefore be broadly interpreted to mean any process which results in the removal of material. Material has been removed from either side of the resulting strap 14 of the piece 10*f*. The strap 14 extends diametrically across the side wall 12.

Figure 16:
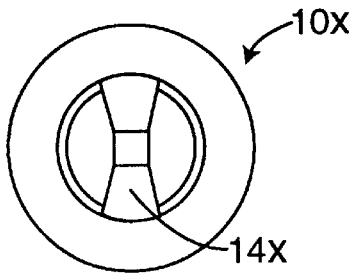
FIGS. 16–18 illustrate alternative piercing patterns.
Figure 17:
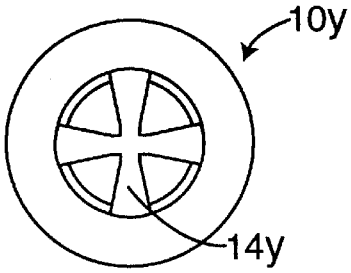
Figure 18:
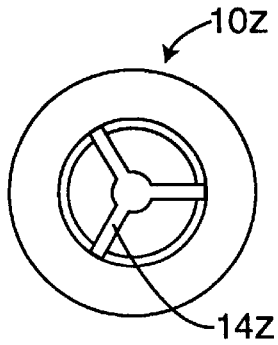

Alternative strap shapes, configurations, and attachment locations are possible and will depend in part on the desired application for a manufactured piece. In fact, the variations are limitless. For example, other possible strap configurations 10*x*, 10*y*, and 10*z* for spark plug ground shields are illustrated in FIGS. 16–18, respectively. Each of the forms 10*x*, 10*y*, and 10*z* includes a unique strap configuration 14*x*, 14*y*, and 14*z*. All of the straps 14 have the commonality of formation by removing material from the bottom 13 of the form 10*e* (FIGS. 12–13).

Figure 19:
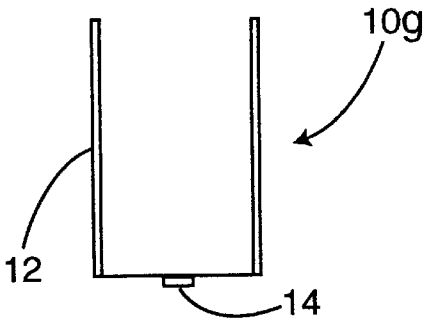
FIGS. 19–32 are sectional views (odd-numbered Figs.) and perspective views (even-numbered Figs.) of the piece at various stages of the manufacturing process following piercing.
Figure 20:
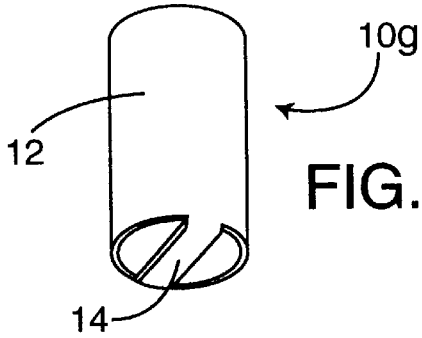

The seventh step is a trimming step wherein the top 15 of the form 10*f* (FIGS. 14–15) is removed to produce the form 10*g* (FIGS. 19–20). The side wall 12 and the strap 14 of form 10*g* are substantially unchanged from form 10*f*.

Figure 21:
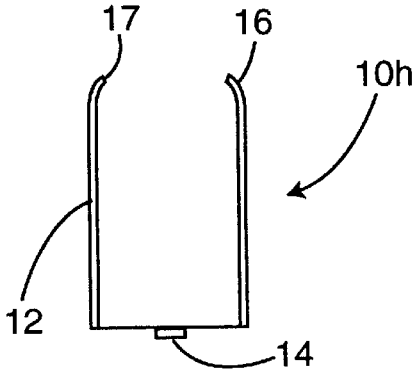
Figure 22:
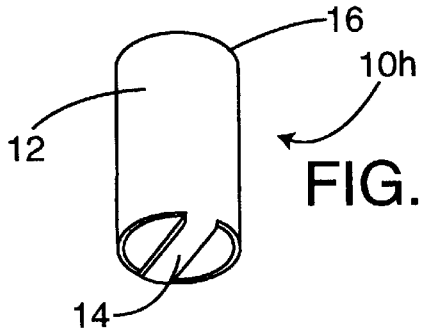

In the eighth step, the upper open end 16 is coned inwardly to produce the form 10*h* (FIGS. 21–22). The coned-in end 16 defines a mouth 17 that is concentric with the side wall 12 and smaller in diameter than the side wall 12. The coning in step prepares the form 10*h* for the push reduction of the following step.

Figure 23:
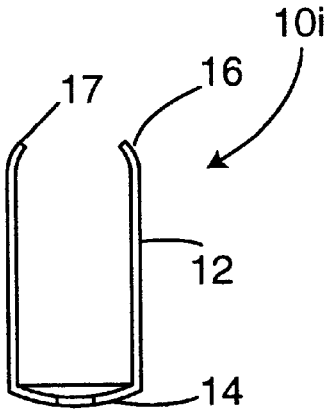
Figure 24:
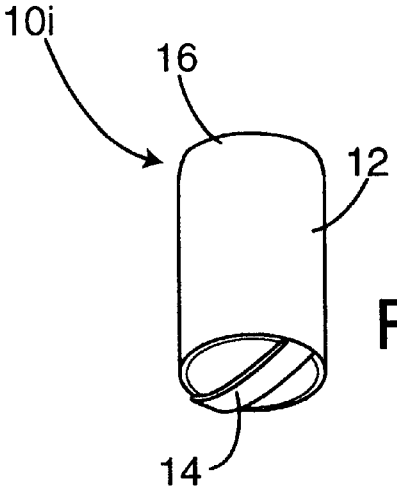

The ninth step is a push reduction resulting in the form 10*i* (FIGS. 23–24). The diameter of the form 10*i* is less than that of the preceding form 10*h*, and the side wall 12 is higher than that of the preceding form. The mouth 17 is approximately the same diameter as the previous step. The length of the strap 14 in the form 10*i* is substantially identical to that in form 10*h*. The strap 14 is pushed or bowed outwardly from the form 10, which results in the strap arcing away from the side wall 12.

Figure 25:
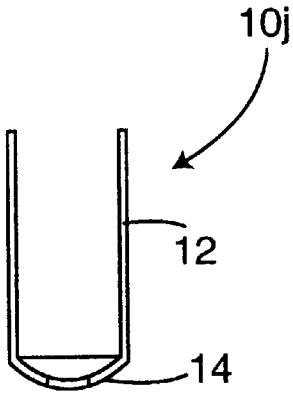
Figure 26:
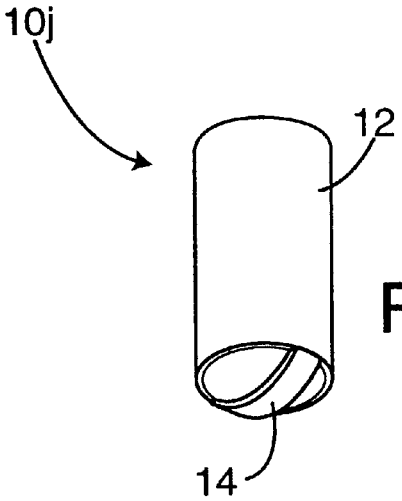

The tenth step is a second push reduction resulting in form 10*j* (FIGS. 25–26). The diameter of the form 10*j* is once again less than the diameter of the preceding form 10*i*, and the side wall 12 of the form 10*j* is higher than that of form 10*i*. Again, the length of the strap 14 remains substantially identical to its length in the preceding forms, resulting in a more pronounced arc or extension away from the remainder of the form 10*j*. The mouth 17 in the form 10*j* is substantially identical in diameter to that of the side wall 12.

Figure 27:
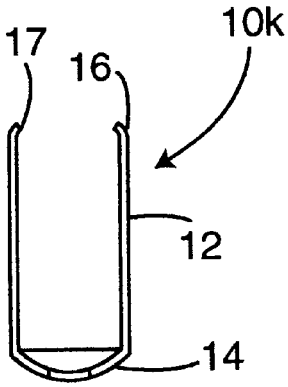
Figure 28:
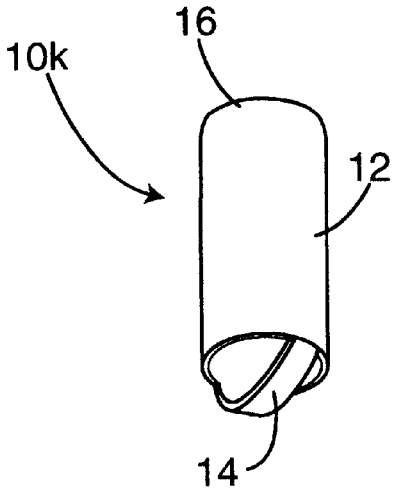

In the eleventh step, the upper end 16 is again coned in to create the form 10*k* (FIGS. 27–28). This step prepares the piece for another push reduction.

Figure 29:
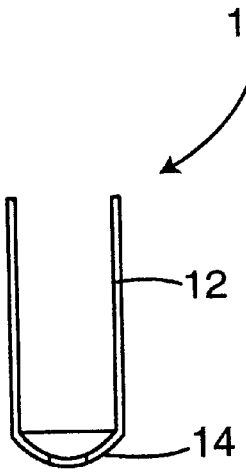
Figure 30:
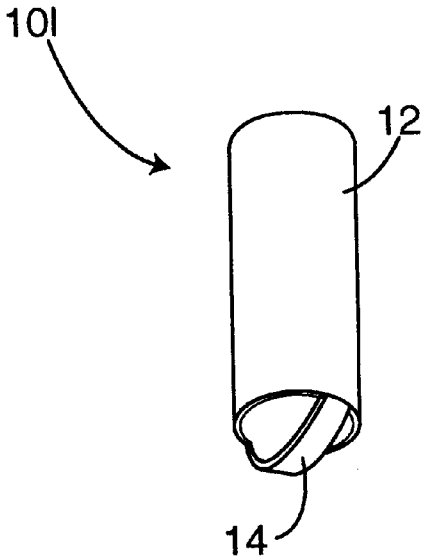
Figure 31:
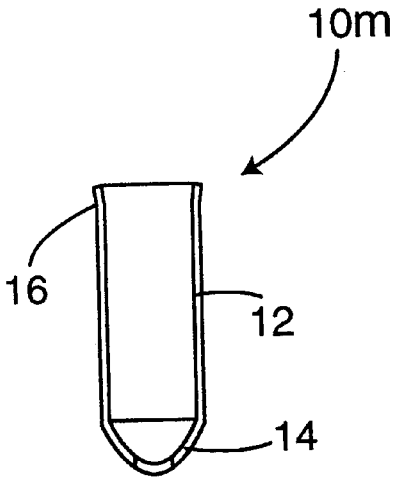
Figure 32:
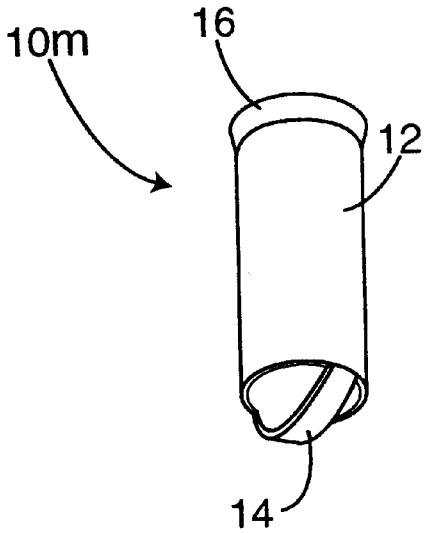

The twelfth step is a push reduction resulting in the form 10*l* (FIGS. 29–30). Once again, the diameter of the form 10*l* is less than the diameter of the preceding form 10*k*, and the side wall 12 is higher than in form 10*k*. Also again, the length of the strap 14 remains substantially unchanged so that it once again arcs further away from the remainder of the form 10*l*.

The thirteenth step is a push reduction resulting in the form 10*m* (FIGS. 31–32) wherein the diameter of the side wall 12 is reduced and the height of the side wall 12 is increased. Additionally, the upper end 16 of the side wall 12 is flared outwardly in this step. The length of the strap 14 once again remains substantially unchanged, resulting in a more pronounced arc to the strap.

The fourteenth and final step is a re-strike resulting in the finished article 10 illustrated in FIGS. 1–2. The re-strike further flares the upper end 16 of the shield 10. The restrike also gives the strap 14 its final shape or configuration, which is flatter with more pronounced comers than the previous form 10*m*.

The shield 10 is fabricated using only conventional deep-drawn stamping steps. However, the steps are performed in a unique order resulting in the novel process. The invention can be used to create virtually any elongated hollow object having openings at a normally closed end. The present invention results in improved products at a lower cost.

The above description is that of a preferred embodiment of the invention. Various alterations and changes can be made without departing from the spirit and broader aspects of the invention as defined in the appended claims, which are to be interpreted in accordance with the principles of patent law including the Doctrine of Equivalents.

The embodiments of the invention in which an exclusive property or privilege is claimed are defined as follows:

1. A method of forming a stamped metallic item comprising the steps of:

forming a metal blank into a cup having a bottom and a side wall;

removing at least two portions of the bottom to leave a strap extending between two portions of the side wall, the strap having a length; and moving the two side wall portions closer together while changing the profile of the strap so that the length of the strap remains substantially unchanged.

2. A method as defined in claim 1 wherein, following said moving step, the strap extends away from the remainder of the item.

3. A method as defined in claim 1 wherein two of said moving steps are performed sequentially.

4. A method as defined in claim 1 wherein said moving step comprises the steps of:

coning the side wall inwardly at the open end of the cup; and push reducing the cup.

5. A method as defined in claim 1 wherein said forming step includes at least two drawing steps performed sequentially.

6. A method of forming an item comprising the steps of:

forming a nonresiliently deformable material into a cup having a bottom and a width;

removing two first portions of the bottom leaving a strap having a length; and reducing the width of the cup without substantially reducing the length of the strap, and changing the profile of the strap.

7. A method as defined in claim 6 wherein the changed profile of the strap is an arc extending away from the remainder of the item.

8. A method as defined in claim 6 wherein said reducing step is performed twice to further reduce the width of the cup.

9. A method as defined in claim 6 wherein said forming step includes at least two drawing steps.

10. A method of forming an item comprising the steps of:

forming a nonresiliently deformable material into a cup having a bottom and a width;

removing a first portion of the bottom leaving a remaining portion having a length; and reducing the width of the cup without substantially reducing the length of the remaining portion, and changing the profile of the remaining portion, said reducing step including coning in the end of the cup opposite the remaining portion and also push reducing the cup.

11. A method of forming a deep-drawn item comprising the steps of:

drawing a metal blank to form a cylindrical cup having a side wall and a bottom integrally connected to the side wall, the side wall and the bottom both having a pre-reduction diameter;

removing at least two portions of the bottom leaving a strap having two opposite ends each integrally connected to the side wall, the strap having a length substantially equal to the pre-reduction diameter; and reducing the pre-reduction diameter of the side wall while maintaining the length of the strap substantially unchanged, and forming the strap into an arc extending away from the remainder of the item.

12. A method as defined in claim 11 wherein two of said reducing steps are performed sequentially.

13. A method as defined in claim 11 where said reducing step includes:

coning the end of the side wall opposite the strap inwardly; and push reducing the cup.

14. A method as defined in claim 11 wherein at least two of said drawing steps are performed sequentially.

* * * * *